United States Patent [19]

Sickler

[11] Patent Number: 4,544,070

[45] Date of Patent: Oct. 1, 1985

[54] SWAY CONTROL ARRANGEMENT FOR HOIST SYSTEMS

[75] Inventor: Emory J. Sickler, Wausau, Wis.

[73] Assignee: Mi-Jack Products, Inc., Hazelcrest, Ill.

[21] Appl. No.: 466,736

[22] Filed: Feb. 16, 1983

[51] Int. Cl.[4] ..... B66C 13/06; B66C 5/02

[52] U.S. Cl. ..... 212/147; 212/146; 212/205; 212/209; 212/218; 294/81.1; 60/468; 60/494; 254/361; 254/273; 242/75.53

[58] Field of Search ..... 212/146–148, 212/205–206, 209, 214, 218; 294/81 SF; 60/468, 494; 417/310; 242/75.53; 254/361, 273

[56] References Cited

U.S. PATENT DOCUMENTS

| | | | |
|---|---|---|---|
| 2,008,687 | 7/1935 | Dean | 254/361 |
| 2,082,473 | 6/1937 | Tyler | 254/361 |
| 2,249,947 | 7/1941 | Doe | 254/361 |
| 2,425,496 | 8/1947 | Tyler | 60/468 |
| 2,447,441 | 8/1948 | Tweedale | 60/468 |
| 2,654,382 | 10/1953 | Ball et al. | 60/466 |
| 2,654,383 | 10/1953 | Hopkins | 60/468 |
| 2,802,337 | 8/1957 | Bunch | 60/468 |
| 3,378,158 | 4/1968 | Lopez | 254/361 |
| 3,532,324 | 10/1970 | Crittenden | 212/147 |
| 3,945,504 | 3/1976 | Wright | 212/147 |
| 4,279,347 | 7/1981 | Appleman | 212/147 |
| 4,358,020 | 11/1982 | Thiele | 212/147 |

FOREIGN PATENT DOCUMENTS

| | | | |
|---|---|---|---|
| 1031022 | 5/1966 | United Kingdom | 212/147 |

*Primary Examiner*—Trygve M. Blix
*Assistant Examiner*—R. B. Johnson
*Attorney, Agent, or Firm*—Dressler, Goldsmith, Shore, Sutker & Milnamow, Ltd.

[57] ABSTRACT

An apparatus for controlling sway and pendulous motion of suspended loads is disclosed which is particularly suited for embodiment in association with a mobile crane or similar hoist system. The arrangement includes stabilizing cables attached to a load lifting structure or spreader of the crane. The stabilizing cable is reeled and unreeled as the load lifting structure is moved up and down, respectively. The reel for the stabilizing cable is connected to a hydraulic motor which is driven by a pressurized fluid source when the load lifting structure is raised to reel in the stabilizing cable reducing and abating any pendulous motion. Upon unreeling of the stabilizing cable and lowering of the load lifting structure, the fluid flow through the hydraulic motor is reversed and directed through bypass circuitry around the hydraulic motor. The bypass circuitry includes a fluid flow restrictor to hydraulically dampen the hydraulic motor during unreeling of the stabilizing cable, thereby allowing the cable to remain taut to effectively abate and/or eliminate the pendulous motion of the load lifting structure and attached load.

2 Claims, 4 Drawing Figures

10
14
14
21
26
22
22
26
21
30
30
20
20
32
32
30
30
22
12
22
26
26
21
21
32
32
33
33

30
21
20
26
HYDRAULIC FLUID SOURCE
36
34
40
42
32
38
44
48
46

SWAY CONTROL ARRANGEMENT FOR HOIST SYSTEMS

FIELD OF THE INVENTION

The present invention relates to a sway control arrangement and more particularly to a sway control arrangement which arrests or abates pendulous motion of a load suspended from a hoist system.

BACKGROUND OF THE INVENTION

A problem typically encountered with the handling of cargo by a hoist system is the sway of the load which occurs due to the suspension of the load by cables, and the necessity to transport the load causing horizontal movement of the suspended load. Horizontal movement usually causes the suspended load to exhibit pendulous motion from horizontal acceleration and deceleration forces inherent in the movement of pivoting cranes, mobile gantry cranes or similar hoist systems. In addition, rotational motion of the suspended load can occur from centrifugal forces when a mobile crane is being steered within a storage area.

In many instances, accurate positioning of the suspended load for deposit and release requires undesirable waiting time to allow the swaying motion of the load to subside. The time intervals required for allowing the swaying motion of the load to cease unduly increases the time interval necessary for handling a particular load, thereby causing large amounts of idle time during the load handling function. In order to increase the efficiency of load handling, it is necessary to eliminate or reduce the time spent waiting for the swaying motion of a load to abate or cease.

If time is not spent waiting for the swaying motion of the suspended load to cease or abate, increased load stresses caused by the swaying motion can be imparted to the hoist structure upon movement of the swaying load up or down by the hoist system. Such stress is undesirable and can be potentially damaging to the hoist structure as well as the suspended load. To eliminate such undesirable stress and potential damage to the load, it is of primary importance to reduce and abate the pendulous motion of the load.

As noted, it is necessary to steady the suspended load of a hoist system in order to avoid longitudinal, transverse and swinging motions which interfere with the accurate placement of such suspended loads onto carriers and the like. For example, in the loading or unloading of cargo containers onto or off truck trailers and subsequently onto and off piggy-back railroad cars, it is necessary to position the container with respect to the trailer or railroad car to properly release and deposit the load. In order to efficiently perform such operations and to avoid undesirable delay in the loading operation, swaying or swinging of the container must be reduced.

Numerous anti-sway devices have been purposed for abating and eliminating pendulous motion of a suspended load. Typically, these anti-sway devices incorporate mechanical control mechanisms including a reel for taking up slack of a guide rope attached to the load supporting portion of the hoist or to the load itself. These prior devices also include mechanical braking mechanisms to create a dampening effect allowing the guide rope to remain taut during lowering of the load, thereby arresting pendulous motion of the suspended load. However, problems occur with use of such mechanical braking mechanisms due to the large amount of heat that is generated in creating the dampening necessary to abate the pendulous motion of the suspended load. The heat developed through mechanical braking causes undesired rapid deterioration of the mechanical braking device creating premature replacement problems and increased costs.

Another disadvantage of the previously known mechanical sway control mechanisms is the necessity of using an unduly complicated rigging system of rope or sway control cable to provide the desired sway abating function. Such complicated riggings are undesirable due to the increased costs, operating expenses and repair complications associated therewith.

Thus, it would be beneficial to provide a sway control arrangement for the hoist system that does not require a mechanical braking device. Further, it would be desirable to eliminate the requirement of a complicated rigging systems for providing the desired sway abating function.

SUMMARY OF THE INVENTION

The present hoist system includes an arrangement for controlling the sway associated with a hoist-suspended load which, among other things, substantially eliminates the above-noted disadvantages of previous devices, while arresting or eliminating the pendulous motion of the suspended load. It will be appreciated by those skilled in the art that the present invention may be utilized for arresting sway of a wide variety of suspended loads, and may be used on many types of hoist systems including, but not limited to, a crane trolley, a mobile crane, a gantry crane or the like.

To eliminate the disadvantages found in previously known sway control arrangements, the present invention provides a sway control arrangement for arresting and eliminating pendulous motion of a suspended load that includes at least one hydraulic motor mounted to the hoist structure, with at least one reel associated with the motor for allowing stabilizing cable to be reeled and unreeled therefrom. Reeling of the cable occurs attendant to raising of the load lifting structure and attached load by the hoist structure, with a constant source of pressurized hydraulic fluid supplied to the hydraulic motor to drive the hydraulic motor and reel up the cable. Unreeling of the cable occurs attendant to the lowering of the load lifting structure and attached load, causing the hydraulic motor to operate in a reverse direction relative to its direction of operation during reeling of the cable.

Hydraulic reverse fluid flow or bypass circuitry is included which allows the hydraulic fluid to be directed from the inlet of the hydraulic motor, around the hydraulic motor, and in the outlet of the hydraulic motor when the cable is being unreeled by lowering of the load lifting structure and the attached load. Hydraulic dampening of the hydraulic motor is preferably created by a restricting orifice within the bypass circuitry which effectively restricts the flow of hydraulic fluid around the hydraulic motor as cable is being unreeled from the reel. Such a restriction of the normal flow of fluid through the hydraulic bypass circuitry arrests and effectively reduces the pendulous motion of the suspended load by keeping the cables attached to the load taut during lowering of the load.

Suitable one-way fluid flow check valves are also provided to prevent flow of hydraulic fluid through the bypass flow circuitry during reeling of the stabilizing cable attendant to lifting of the suspended load.

The present invention provides several distinct benefits and advantages not found in previous devices. One such benefit is that a sway control arrangement herein illustrated eliminates the need for a mechanical braking device which eventually requires replacement. In addition, the present invention eliminates the need for a complicated mechanical rigging system which is frequently necessary to effect the required dampening in a sway control system incorporating a mechanical braking device.

Another benefit of the sway control system of the present invention is that the system operates automatically, abating and/or eliminating pendulous motion of the suspended load without any control or adjustment by a human operator during the raising and lowering of the load and during transport of the load. Additionally, the present invention provides a simplified and less expensive apparatus for arresting and/or eliminating pendulous motion of a suspended load.

Numerous other advantages and features of the present invention will become readily apparent from the following description of the invention and embodiment thereof, from the claims, and from the accompanying drawings.

DESCRIPTION OF THE PREFERRED EMBODIMENT

Figure 1:
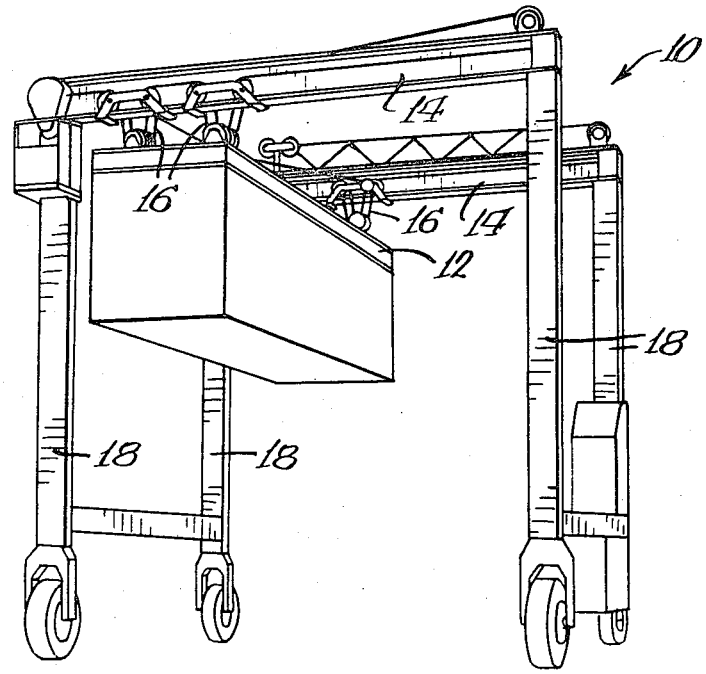
FIG. 1 is a full perspective view of a mobile trolley type crane embodying the present sway control arrangement.

While this invention is susceptible of embodiment in many different forms, there is shown in the drawings and will herein be described in detail a presently preferred embodiment, with the understanding that the present disclosure is to be considered as an exemplification of the principles of the invention and is not intended to limit the invention to the embodiment illustrated. It is to be understood that variations may be made by one skilled in the art without departing from the true spirit and scope of the invention.

Upon inspection of FIG. 1, it will be seen that a hoist structure comprising mobile load handling trolley 10 (sometimes referred to as a gantry crane) having a load lifting structure or spreader 12 suspended below crossbeams 14 by carrying cables 16 is therein illustrated. Cables 16 are part of the load-supporting hoist mechanism. The spreader 12 for lifting and carrying the load is vertically movable within the area defined by leg beams 18 which vertically depend from cross beams 14. When the load is lifted and moved in a horizontal direction, the acceleration and deceleration forces of the movement induce pendulous motion in the cables 16 causing the load to experience sway to and fro.

Figure 2:
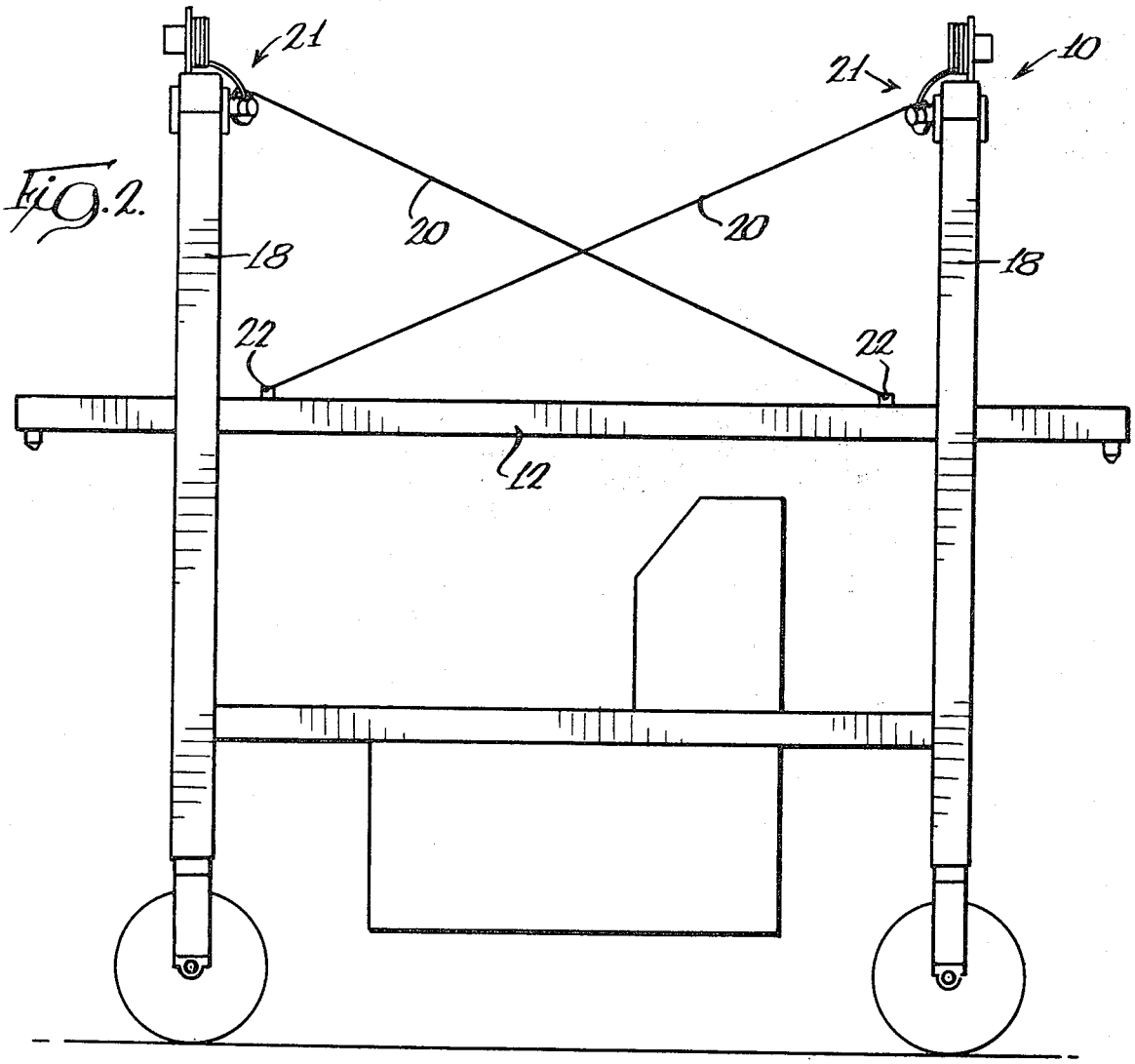
FIG. 2 is a side elevational view of the mobile trolley type crane of FIG. 1 showing the rigging of the stabilizing cables of the subject invention.
Figure 3:
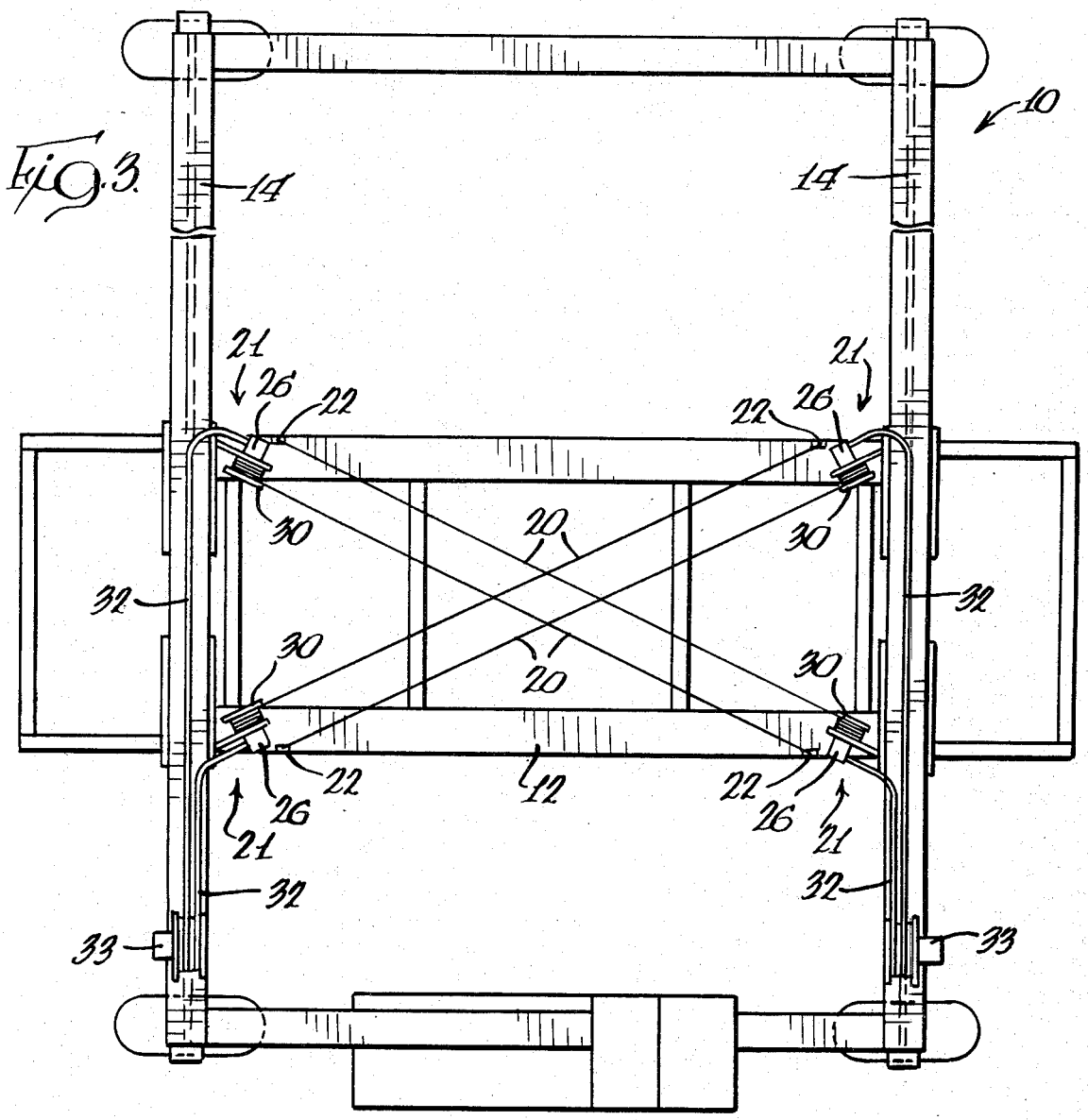
FIG. 3 is a top plan view of the mobile trolley type crane of FIG. 1 showing the stabilizing cables and stabilizing cable reels of the subject invention.

Attached to spreader 12 are stabilizing cables 20, which are part of the present sway controlling system. Cables 20 are provided for stabilizing the spreader 12 and the load, and do not directly support the weight of the load. The stabilizing cables 20 are paid out and taken up as the spreader 12 is lowered and raised, respectively, and extend from respective sway control mechanisms 21 to the opposite edges of the lifting spreader (FIG. 2) where their lower ends 22 are secured to the lifting spreader 12.

Each sway control mechanism 21 (four being illustrated) includes a stabilizing hydraulic motor 26 to which an associated stabilizing reel 30 is operatively connected. Sway control mechanims 21 are mounted generally adjacent crossbeams 14 of trolley 10, and are movable transversely of trolley 10 together with spreader 12. One end of each stabilizing cable 20 is attached to a respective stabilizing reel 30 to allow reeling and unreeling of the stabilizing cables 20. Stabilizing hydraulic motor 26 keeps a continuous torque applied to its respective stabilizing reel 30 to wind the stabilizing cables 20 and take up slack in the cables.

Continuous torque for reels 30 is provided by a continuous supply of pressurized hydraulic fluid through conduit lines 32 to each motor 26. This source of pressurized fluid is typically provided by a hydraulic pump powered by an internal combustion engine which provides the power allowing the trolley 10 to maneuver. Reeling devices 33 are provided on each crossbeam 14 for reeling and unreeling conduit lines 32 as spreader 12 is moved transversely below the crossbeams.

Figure 4:
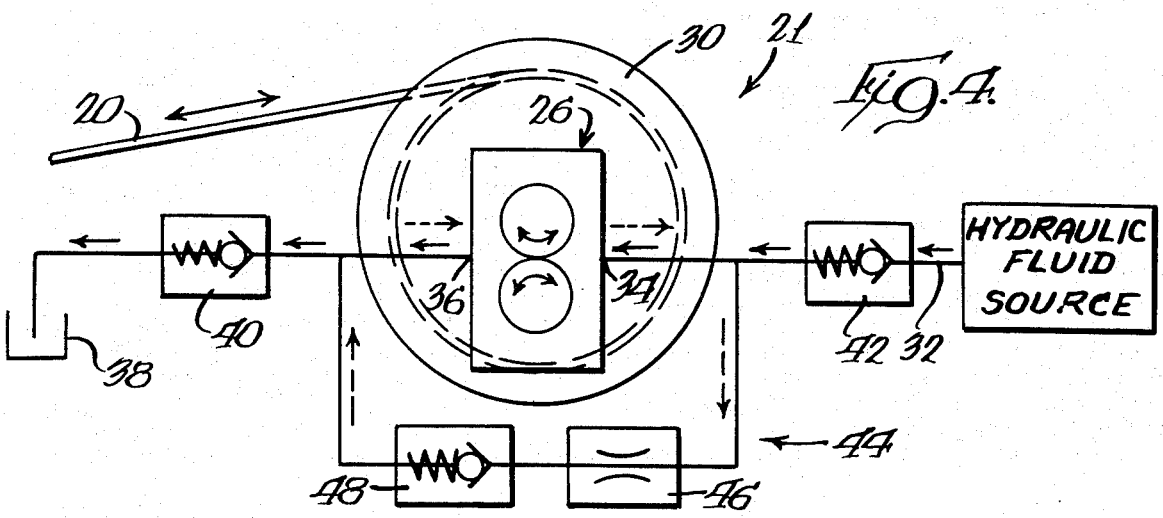
FIG. 4 is a diagrammatic/schematic view showing the hydraulic circuitry as well as the associated parts of the present sway control arrangement.

Referring to FIG. 4, the details of one of the sway control mechanisms 21 are illustrated and will now be described, with the understanding that each sway control mechanism of the trolley is similarly configured and operated. Fluid pressure within conduit line 32 is supplied to the inlet 34 of stabilizing hydraulic motor 26 with which stabilizing reel 30 is associated. This constant hydraulic fluid pressure allows any slack in stabilizing cables 20 to be taken up and allows the cables 20 to be maintained in a constantly taut state. The pressurized hydraulic fluid flows through hydraulic motor 26 and exits at the outlet 36 of hydraulic motor 26. As the hydraulic fluid exits the hydraulic motor 26, it flows to a sump or tank 38 which provides storage for the hydraulic fluid necessary to operate the trolley 10.

As shown by solid arrows in FIG. 4, the hydraulic fluid flow during reeling of the stabilizing cable 20 is in a first direction from the inlet 34 to the outlet 36 of stabilizing hydraulic motor 36. However, when the load connected to the spreader 12 is lowered, stabilizing cable 20 will pay out from stabilizing reel 30 causing the reel to rotate in a direction opposite to the direction of rotation for tightening the stabilizing cable 20. Opposite rotation of reel 30 causes stabilizing hydraulic motor 26 to rotate in an opposite direction producing a reverse flow of hydraulic fluid within the hydraulic motor. During the reverse flow, fluid flows in a second, opposite direction from the outlet 36 through stabilizing hydraulic motor 26 to the inlet 34 of the motor.

FIG. 4 further shows that a one-way fluid flow check valve 40 is included between the outlet 36 and the tank 38, downstream of the stabilizing hydraulic motor 26. This valve prevents fluid from flowing from the tank 38 to the outlet 36 and through the stabilizing hydraulic motor 26 when the stabilizing cable is being unreeled from stabilizng reel 30. A similar one-way fluid flow check valve 42 is included between the inlet 34 and the source of pressurized hydraulic fluid, upstream of the stabilizing hydraulic motor 26. The second check valve 42 prevents fluid flow from the inlet 34 of stabilizing hydraulic motor 26 back to the source of pressurized fluid when the fluid pressure is greater than that provided by the source. Therefore, when the fluid flow is reversed by lowering of the spreader 12 and attached load, fluid is effectively isolated between the two check valves 40 and 42.

In order to hydraulically dampen motor 26 during reverse fluid flow, bypass fluid flow circuit 44 is included. Bypass circuit 44 is adapted to communicate between the inlet 34 of hydraulic motor 26 and the outlet 36 of the hydraulic motor. This bypass circuit 44 directs the reverse flow of fluid (illustrated by phantom arrows in FIG. 4) from the inlet 34 of hydraulic motor 26 to the outlet 36.

Bypass fluid flow circuit 44 also includes a fluid flow restrictor 46 in series flow relationship with the inlet 34 and outlet 36 of hydraulic motor 26. The flow restrictor 46 preferably comprises a flow-restricting orifice. Since fluid is flowing within the bypass circuit 44 when the stabilizing cable 20 is being unreeled from reel 30, the restriction of fluid flow within the bypass circuit 44 provides a dampening effect upon unreeling or pay out of the stabilizing cable 20, preventing uncontrolled unreeling of the stabilizing cable 20. This effectively allows stabilizing cable 20 to remain taut at all times thereby reducing and/or eliminating pendulous motion of the spreader and attached load to which stabilizing cable 20 is attached.

When the spreader 12 and the attached load cease to be lowered, stabilizing cable 20 ceases to be unreeled from stabilizing reel 30 and stops turning hydraulic motor 26. Since the source of pressurized fluid is continual, the flow of hydraulic fluid immediately reverses direction and fluid begins passing in an opposite direction through the one-way fluid flow check valve 42 to the inlet 34 of stabilizing motor 26 when spreader 12 is raised. During raising of the spreader, fluid no longer flows through the bypass circuit 44 since the circuit includes a one-way fluid flow check valve 48 that only permits fluid flow at a pressure higher than that supplied by the source of pressurized fluid. When the fluid flow is reversed and stabilizing cable 20 is being unreeled from stabilizing reel 30, the fluid pressure created by the reversal of the fluid flow is substantially greater than the fluid pressure supplied by the source of pressurized fluid, and fluid flow is permitted through the bypass circuit 44.

Since reverse fluid flow is restricted by fluid flow restrictor 46, the unreeling of stabilizing cable 20 from stabilizing reel 30 is hydraulically dampened. During unreeling, motor 26 effectively operates as a pump, with the work done by the hydraulic motor 26 acting to heat the hydraulic fluid within the bypass circuit 44, with this heat being easily dissapated. This type of fluid flow arrangement allows the stabilizing cable 20 to remain taut at all times and effectively provides hydraulic dampening of the hydraulic motor 26 during payout of the stabilizing cable 20, thereby arresting and/or eliminating pendulous motion of the spreader 12 and its associated load.

Thus, the present invention provides a new and novel method for arresting and/or eliminating pendulous motion of a suspended load which occurs in the process of transporting the load. The present sway control arrangement automatically adjusts to control the sway of any weight of suspended loads and is a continually operating mechanism.

The presently embodied sway control arrangement effectively eliminates the need for a mechanical braking device as well as the necessity of requiring complicated rigging systems to effectively abate and eliminate pendulous motion of the spreader and attached load. Further, the present invention provides a relatively simplified and less expensive apparatus for arresting pendulous motion of a suspended load.

While the present invention has been illustrated and embodied within a trolley type crane including a spreader as the load lifting structure, it is readily apparent that the apparatus could be effectively used to arrest sway of a load suspended from a single cable. Therefore, the present sway control apparatus can effectively be used in a boom type crane as well as a crane utilizing a load beam as the load lifting structure. Such an application would usually require fewer stabilizing cables to effectively abate and/or eliminate the pendulous motion of the load.

The present invention has been described generally with respect to the herein illustrated embodiment. It will be clear to those skilled in the art that modifications and/or variations of the disclosed invention can be made without departing from the scope of the invention as set forth. This invention is defined by the claims that follow.

What is claimed is:

1. A mobile gantry crane comprising:

frame means;

a vertically movable load lifting structure;

hoist means including cables for suspending and raising and lowering said lifting structure and a load connected thereto;

means for controlling sway of said suspended load including sway control cable means connected to said lifting structure;

means for reeling and unreeling said sway control cable means;

means for supplying pressurized hydraulic fluid;

stabilizing hydraulic motor means adapted to receive pressurized fluid from said fluid supplying means for driving said reeling means to reel said sway control cable means during pressurized hydraulic fluid flow through said motor means in a first direction, said motor means being adapted to hydraulically dampen and control sway of said suspended load by receiving restricted reverse fluid flow therethrough in a second direction during unreeling of said sway control cable means;

reverse fluid flow circuit means adapted to communicate between a fluid inlet and a fluid outlet of said stabilizing hydraulic motor means for permitting reverse flow therethrough, said circuit means including flow restricting means for restricting said reverse fluid flow through said stabilizing hydraulic motor means to hydraulically dampen and control sway of said suspended load, and one-way valve means disposed in series flow relation with said flow restricting means, said one-way valve means being adapted to open for reverse fluid flow through said circuit means in response to fluid pressurization greater than the pressure of fluid from said source; and means to prevent reverse flow of hydraulic fluid to said source of pressurized fluid.

2. The mobile gantry crane of claim 1, wherein said sway control cable means includes a plurality of sway control cables connected to said lifting structure.

* * * * *